US008191742B1

(12) United States Patent
Brewer

(10) Patent No.: US 8,191,742 B1
(45) Date of Patent: Jun. 5, 2012

(54) BALL CAP SHAPER

(76) Inventor: Aaron F. Brewer, Oakland, CA (US)

( * ) Notice: Subject to any disclaimer, the term of this patent is extended or adjusted under 35 U.S.C. 154(b) by 129 days.

(21) Appl. No.: 12/791,972

(22) Filed: Jun. 2, 2010

Related U.S. Application Data

(60) Provisional application No. 61/277,838, filed on Oct. 1, 2009.

(51) Int. Cl.
*A42C 1/00* (2006.01)

(52) U.S. Cl. ..... 223/24; 223/12

(58) Field of Classification Search ..... 223/7, 24, 223/25, 12, 84
See application file for complete search history.

(56) References Cited

U.S. PATENT DOCUMENTS

| | | | | |
|---|---|---|---|---|
| 1,649,338 | A * | 11/1927 | Brodin | 223/24 |
| 4,941,601 | A | 7/1990 | Thomas et al. | |
| 4,998,992 | A * | 3/1991 | Richlin et al. | 223/66 |
| 5,725,134 | A * | 3/1998 | Weltge | 223/24 |
| 6,648,189 | B1 * | 11/2003 | Minton et al. | 223/24 |
| 2010/0219214 | A1 * | 9/2010 | Pullum | 223/84 |

OTHER PUBLICATIONS

Threadbanger, http://www.youtube.com/watch?v=WZwC1D5KVLY, Mar. 19, 2009, see 4:30-5:00.*
http://www.strictlyfitted.com/blog/2009/04/fitted-baseball-cap-shaper/; Jul. 12, 2009; Strictly Fitteds.

* cited by examiner

*Primary Examiner* — Shaun R Hurley
*Assistant Examiner* — Andrew Sutton
(74) *Attorney, Agent, or Firm* — Neustel Law Offices

(57) ABSTRACT

A ball cap shaper for restoring and maintaining an original pre-washed shape of a ball cap. The ball cap shaper generally includes a support apparatus having a lower surface and an upper surface, the lower surface being substantially planar, the upper surface having a curved-hemispherical shape. The support apparatus is comprised of a compressible and resilient material. An absorbent member having a lower surface and an upper surface covers at least a portion of the support apparatus, wherein the lower surface of the absorbent member is in contact with the upper surface of the support apparatus to substantially cover an entire the upper surface of the support apparatus. The upper surface of the absorbent member faces outwardly from the support apparatus and adapted to receive an inside surface of a crown of a cap for retaining a curved-hemispherical shape of the cap and absorbing moisture from the crown.

3 Claims, 7 Drawing Sheets

BALL CAP SHAPER

CROSS REFERENCE TO RELATED APPLICATIONS

I hereby claim benefit under Title 35, United States Code, Section 119(e) of U.S. provisional patent application Ser. No. 61/277,838 filed Oct. 1, 2009. The 61/277,838 application is currently pending. The 61/277,838 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a ball cap shaping structure and more specifically it relates to a ball cap shaper for efficiently restoring and maintaining an original pre-washed shape of a ball cap.

2. Description of the Related Art

Any discussion of the related art throughout the specification should in no way be considered as an admission that such related art is widely known or forms part of common general knowledge in the field.

Ball caps have been in use for years and are typically formed in various shapes and used to represent various companies, logos, slogans, etc. Because of the extensive use that ball caps generally undergo, there is often a need to wash the ball caps. After washing, if not properly held in a preferred shape, the crown of the ball cap can become deformed which can affect comfortable wearability of the ball cap as well as create an unaesthetic appearance. Because of the inherent problems with the related art, there is a need for a new and improved ball cap shaper for efficiently restoring and maintaining an original pre-washed shape of a ball cap.

BRIEF SUMMARY OF THE INVENTION

A system for efficiently restoring and maintaining an original pre-washed shape of a ball cap. The invention generally relates to a ball cap shaping structure which includes a support apparatus having a lower surface and an upper surface, the lower surface being substantially planar, the upper surface having a curved-hemispherical shape. The support apparatus is comprised of a compressible and resilient material. An absorbent member having a lower surface and an upper surface covers at least a portion of the support apparatus, wherein the lower surface of the absorbent member is in contact with the upper surface of the support apparatus to substantially cover an entire the upper surface of the support apparatus. The upper surface of the absorbent member faces outwardly from the support apparatus and adapted to receive an inside surface of a crown of a cap for retaining a curved-hemispherical shape of the cap and absorbing moisture from the crown.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
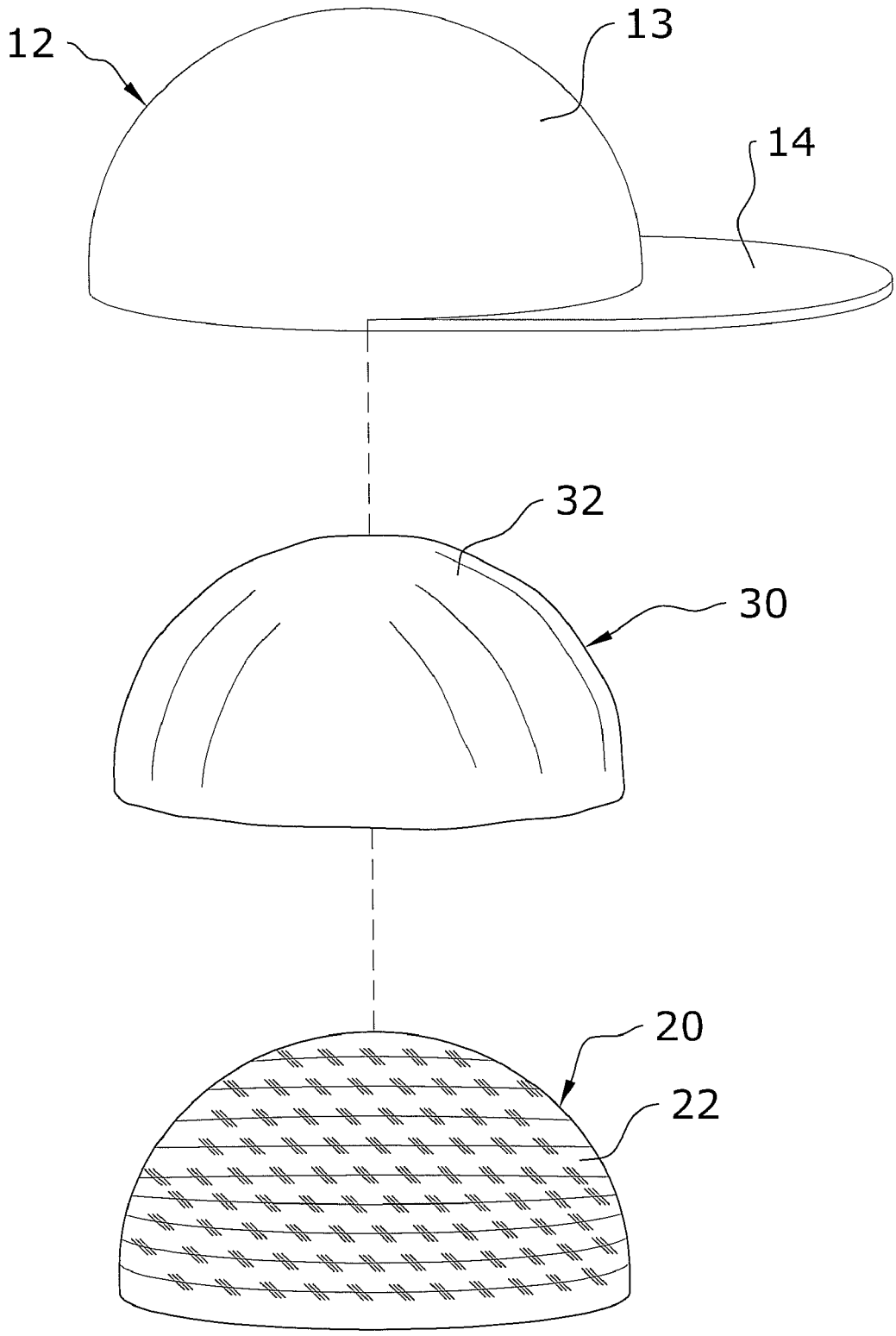
FIG. 1 is an exploded upper perspective view of the present invention and a cap.
Figure 2:
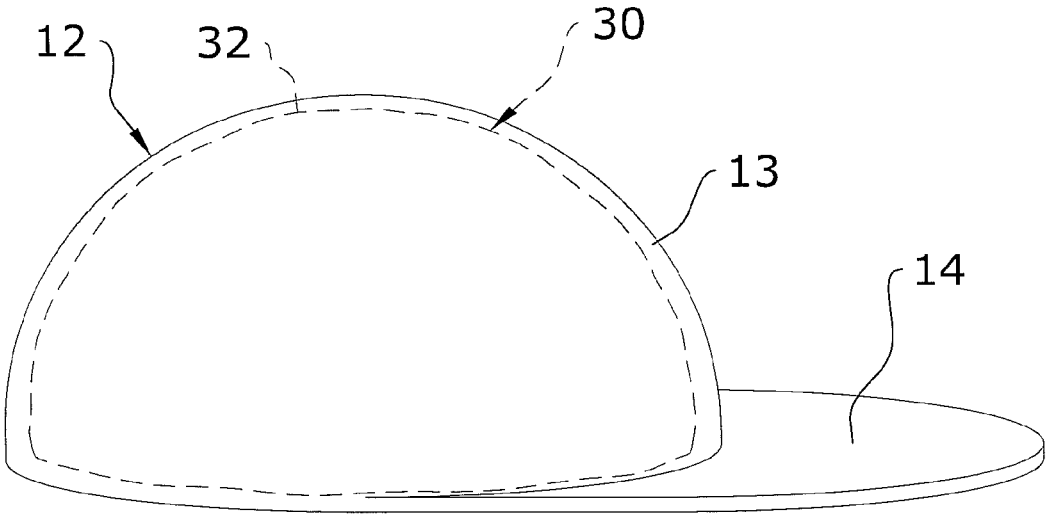
FIG. 2 is an upper perspective view of the present invention shaping the crown portion of the cap.
Figure 3:
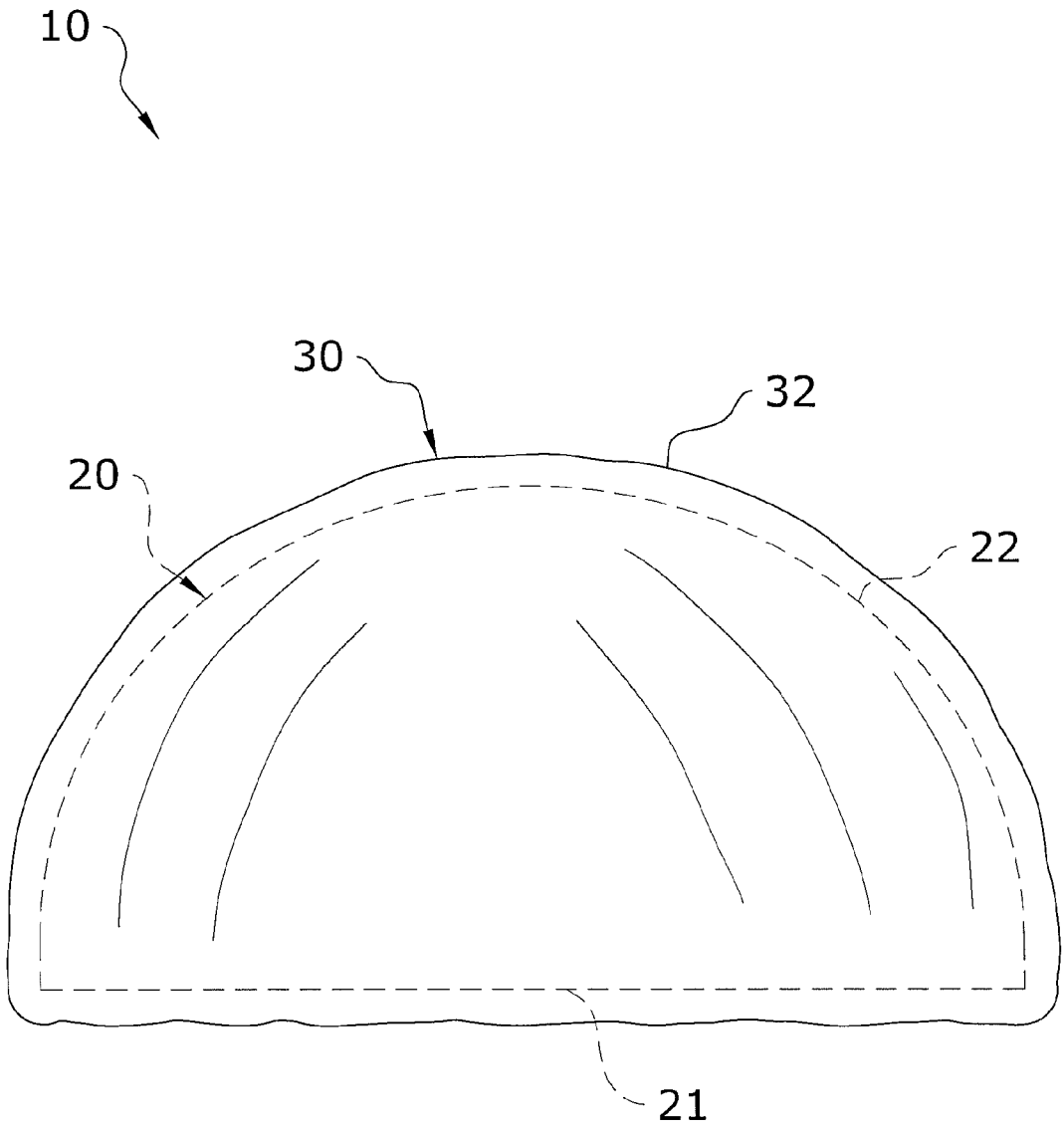
FIG. 3 is a side view of the present invention.
Figure 4:
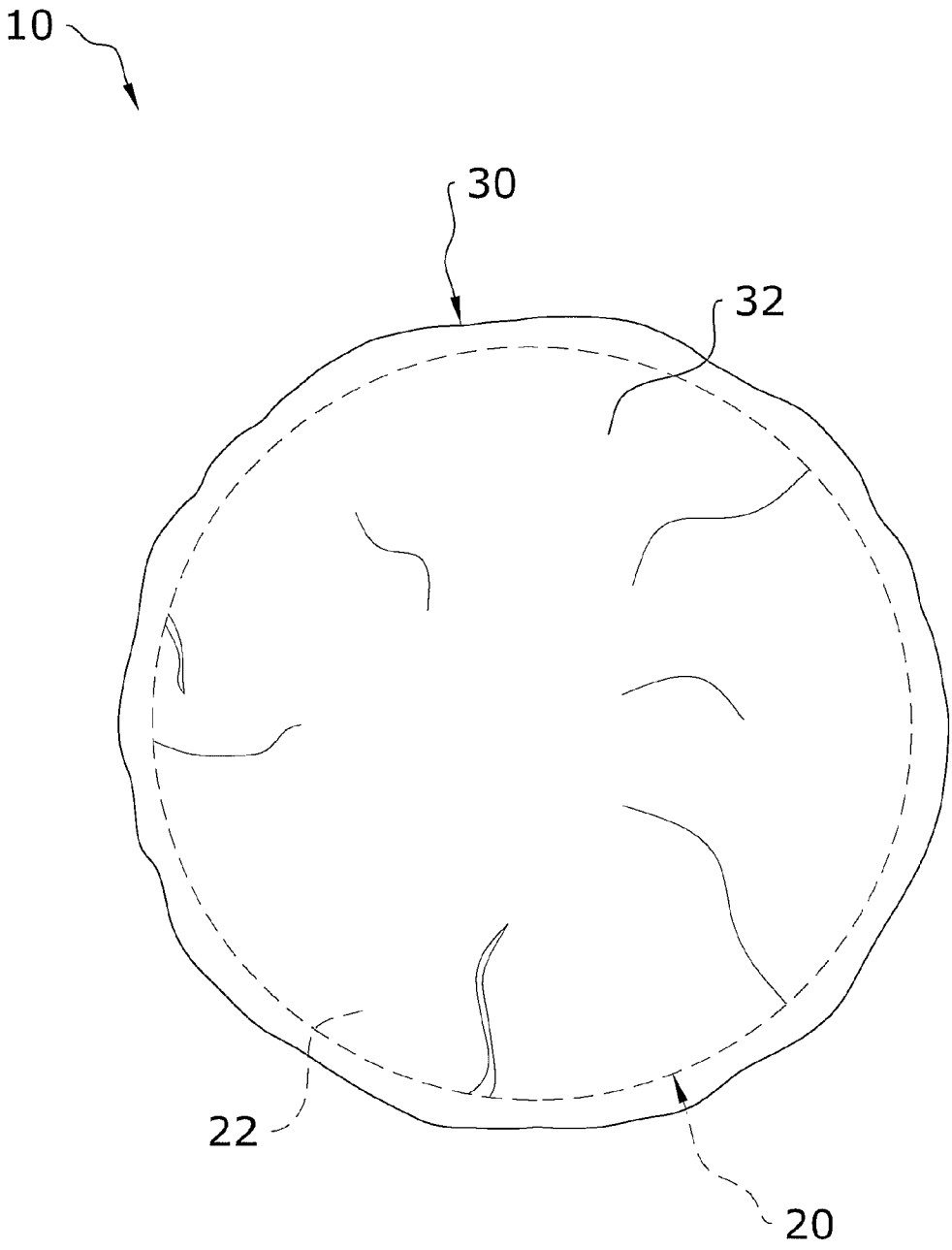
FIG. 4 is a top view of the present invention.
Figure 5:
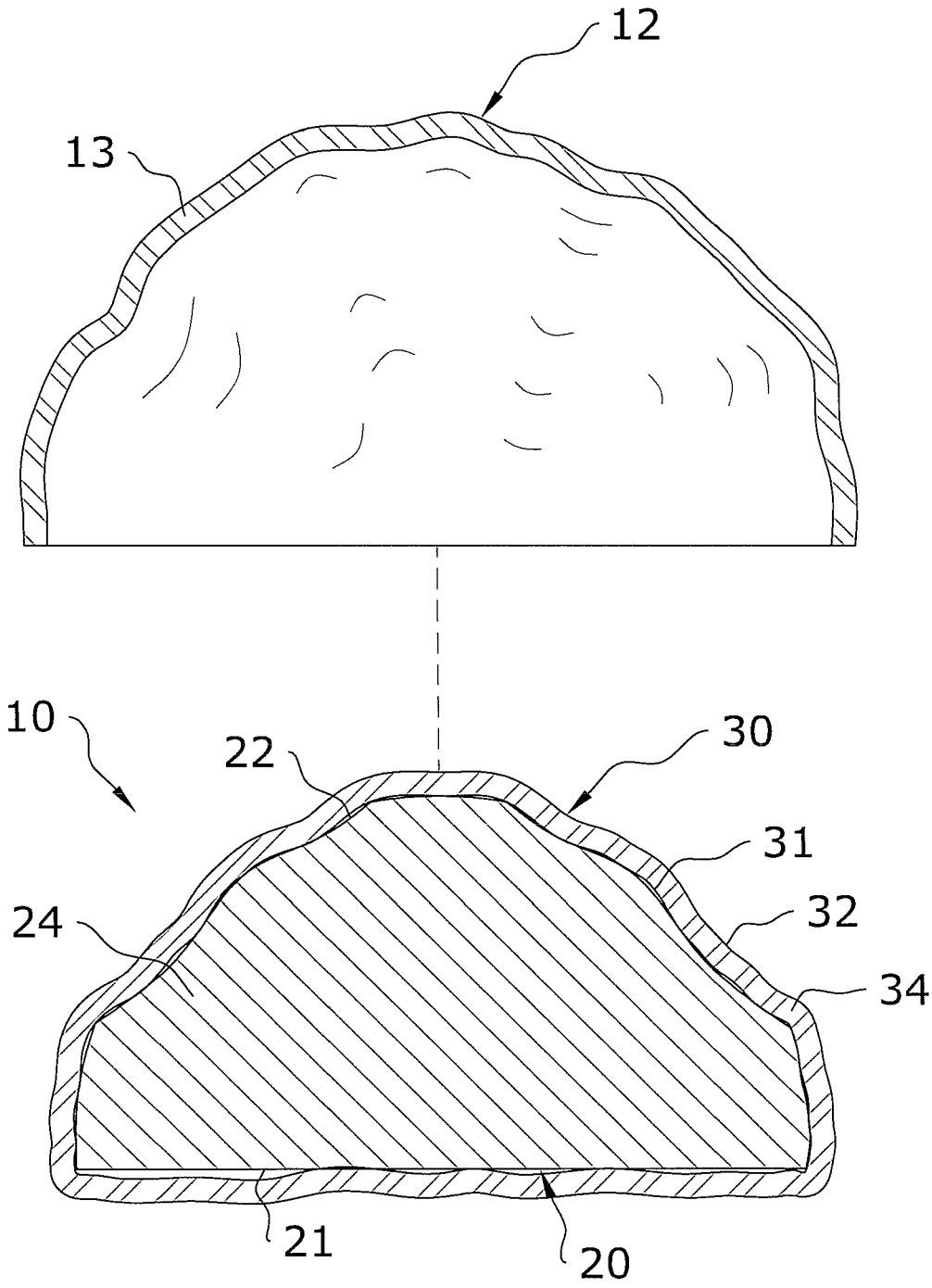
FIG. 5 is a side sectional view illustrating the present invention being compressed and aligned with the crown portion of a deformed cap.
Figure 6:
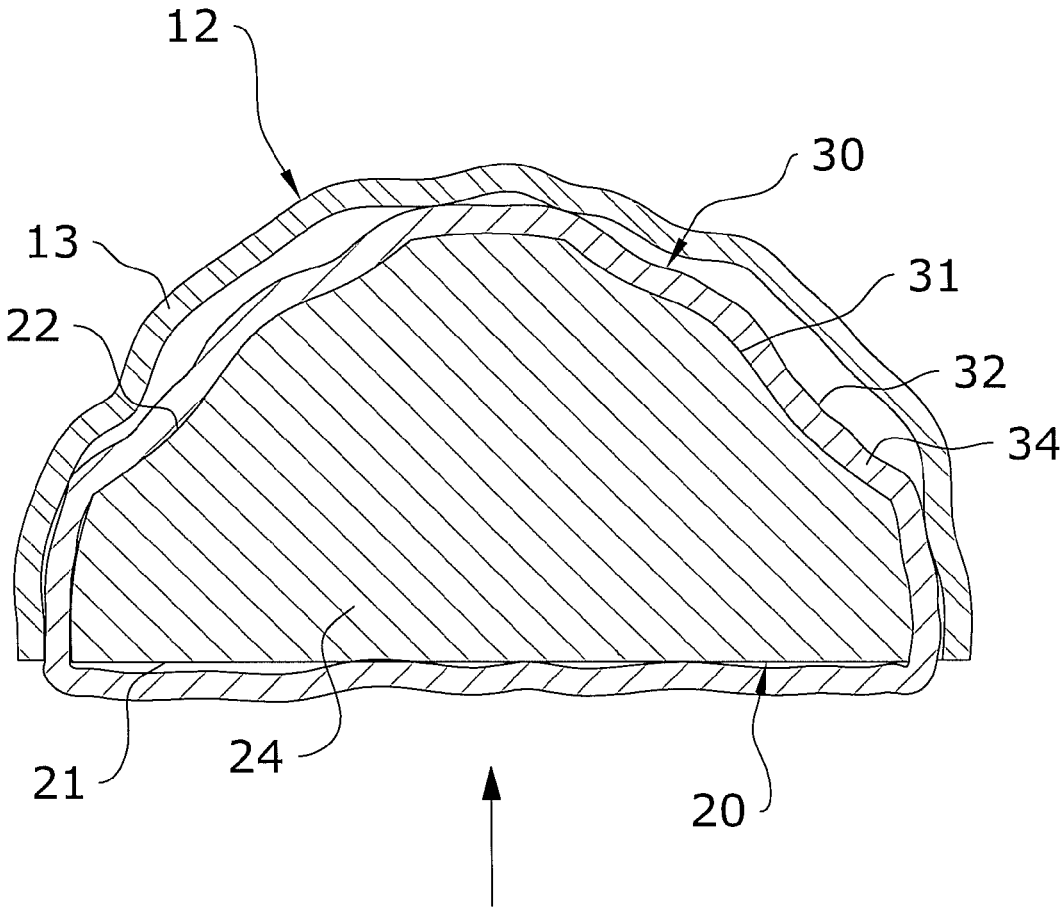
FIG. 6 is a side sectional view illustrating the present invention being compressed and inserted within the crown portion of a deformed cap.
Figure 7:
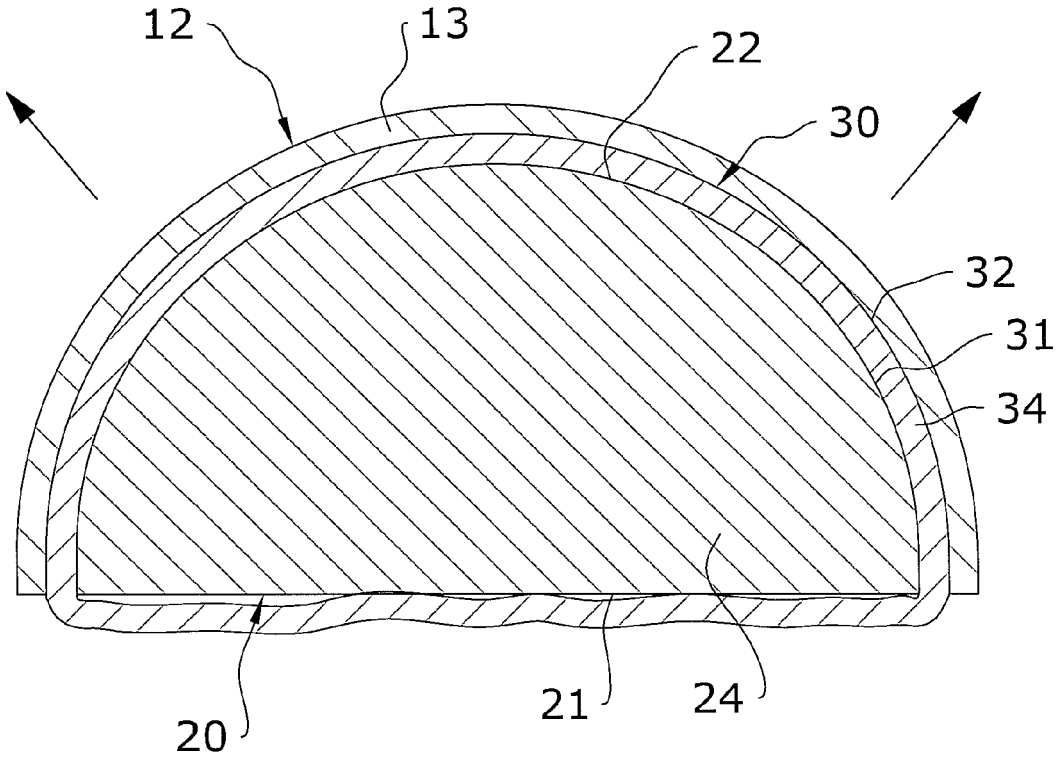
FIG. 7 is a side sectional view illustrating the present invention being released and allowed to expand to the original curved-hemispherical shape and pushing outwards upon the crown portion of the cap to return the shape of the crown portion to a curved-hemispherical shape.

A. Overview.

Turning now descriptively to the drawings, in which similar reference characters denote similar elements throughout the several views, FIGS. 1 through 7 illustrate a ball cap shaper 10, which comprises a support apparatus 20 having a lower surface 21 and an upper surface 22, the lower surface 21 being substantially planar, the upper surface 22 having a curved-hemispherical shape. The support apparatus 20 is comprised of a compressible and resilient material. It is appreciated that the support apparatus 20 may be shaped in various other shapes in an uncompressed state rather than the curved-hemispherical shape, all which match the shape of the crown portion 13 of the cap 12 that is desired to be shaped.

An absorbent member 30 having a lower surface 31 and an upper surface 32 covers at least a portion of the support apparatus 20, wherein the lower surface 31 of the absorbent member 30 is in contact with the upper surface 22 of the support apparatus 20 to substantially cover an entire the upper surface 22 of the support apparatus 20. The upper surface 32 of the absorbent member 30 faces outwardly from the support apparatus 20 and adapted to frictionally receive an inside surface of a crown portion 13 of a cap 12 for retaining a curved-hemispherical shape of the cap 12 and absorbing moisture from the crown portion 13.

The cap shaper 10 is generally used with a hat having a flexible crown portion 13 that is originally formed in a curved-hemispherical shape. The cap 12 may also include a bill portion 14 extending from the crown portion 13, such as is common with ball cap 12*s* of various structures and sizes. The crown portion 13 or bill portion 14 may have various logos, slogans, etc. thereon and may be comprised of various colors. It is appreciated that other types of caps or hats may be utilized with the present invention rather than the illustrated ball cap 12.

B. Support Apparatus.

The support apparatus 20 is generally comprised of a one-piece structure and is sized to fit within the inside of the crown portion 13 of the cap 12 so that the support apparatus 20 pushes outward upon the crown portion 13 and forces the crown portion 13 back to the curved-hemispherical shape. The support apparatus 20 is comprised of a compressible and resilient material, such as foam or memory foam. It is appreciated that various alternate materials may be used with the support apparatus 20 all which allow the support apparatus 20 to compress and be resilient.

The support apparatus 20 generally comprises an upper surface 22, a lower surface 21, and a solid core 24 forming the supporting center of the support apparatus 20. The lower surface 21 is generally planar and circular in shape to rest flat upon a table or supporting surface. The upper surface 22 is generally comprised of a curved-hemispherical shape and extends upwardly from the lower surface 21. It is appreciated that the upper surface 22 may take the form of various other shapes all which conform to the shape of the inside of the crown portion 13. In any case, the upper surface 22 rises above the lower surface 21 and is able to return and maintain an original shape after compression.

The support apparatus 20 generally has a larger volume (in a non-compressed state) than the volume of the inside of the crown portion 13 so that the support apparatus 20 may be compressed to fit within the crown portion 13 and then released to expand and push outwards upon the crown portion 13 to redefine the curved-hemispherical shape of the crown portion 13. It is appreciated that the volume of the support apparatus 20 (in a non-compressed state) is at least as large as the volume of the crown portion 13 so that at least some frictional contact can be made between the inside surface of the crown portion 13 and the upper surface 32 of the absorbent member 30 to retain the original shape of the crown portion 13.

C. Absorbent Member.

The absorbent member 30 generally surrounds a substantial portion of the support apparatus 20 and makes direct contact with the inside surface of the crown portion 13 of the cap 12 to absorb moisture from the crown portion 13 of the cap 12 thus decreasing a drying time of the cap 12. The support apparatus 20 is comprised of a flexible material to flex in shape with the support apparatus 20. Such material for the absorbent member 30 may include cloth or a towel-like material; however it is appreciated that various alternate materials may be used with the absorbent member 30 all which allow the absorbent member 30 to flex and absorb moisture.

The support apparatus 20 generally comprises an upper surface 32, a lower surface 31, and a solid core 34 forming the supporting center of the absorbent member 30. The lower surface 31 and the upper surface 32 are flexible in shape and parallel with each other to conform with the shape of the support apparatus 20. The lower surface 31 generally covers the upper surface of the support apparatus 20 thus forming a curved-hemispherical shape.

The lower surface 31 of the absorbent member 30 may also cover the lower surface 21 of the support apparatus 20 rather than solely the upper surface 22 of the support apparatus 20 to provide a greater surface area to absorb and retain moisture. The upper surface 32 of the absorbent member 30 generally makes direct frictional contact with the inside surface of the crown portion 13 of the cap 12 and preferably the entire upper surface 32 of the absorbent member 30 is able to make contact with the entire inside surface of the crown portion 13 to form a uniform curved-hemispherical shape with the crown portion 13.

The absorbent member 30 is generally fixed to the support apparatus 20; however the absorbent member 30 may be removable with respect to the support apparatus 20 to allow for the absorbent member 30 and the support apparatus 20 to be efficiently cleaned and dried after usage. The absorbent member 30 is thus preferably comprised of a separate structure than the support apparatus 20. It is appreciated that the removable absorbent member 30 in FIG. 1 is simply for illustration purposes and the absorbent member 30 may be fixedly attached or removably attached to the support apparatus 20.

D. Operation of Preferred Embodiment.

The present invention is generally used after washing the cap 12 or after the crown portion 13 of the cap 12 becomes wet and is desired to dry. In use, the upper surface 21 and core 24 of the support apparatus 20 are compressed downwards and/or inwards to reduce the volume of the support apparatus 20. The support apparatus 20 is compressed until the volume of the cap shaper 10 is less than the volume of the inside of the crown portion 13. Once the volume of the cap shaper 10 is less than the crown portion 13, the cap shaper 10 is introduced or inserted within the inside of the crown portion 13 so that the outer surface of the absorbent member 30 and the curved-hemispherical part of the cap shaper 10 faces the inside surface of the crown portion 13.

Once the cap shaper 10 is fully inserted within the crown portion 13, the support apparatus 20 is released to allow the support apparatus 20 to expand back to an original curved-hemispherical shape and the absorbent member 30 to flex or bend outwards with the support apparatus 20 until the cap shaper 10 engages the inside surface of the crown portion 13 and pushes outward upon the crown portion 13 so that the crown portion 13 obtains a curved-hemispherical shape which is generally identical to the original shape of the crown portion 13 when new.

The cap shaper 10 is left inserted within the crown portion 13 of the cap 12 as the crown portion 13 dries, wherein the during this time, the absorbent member 30 continually absorbs moisture from the crown portion 13 thus decreasing a drying time of the crown portion 13 of the cap 12. After the crown portion 13 is dry, the cap shaper 10 is again compressed until the volume of the cap shaper 10 is less than the volume of the crown portion 13 and the cap shaper 10 is removed from the crown portion 13. The crown portion 13 is now able to independently retain the curved-hemispherical shape.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A method of shaping a crown portion of a ball cap, comprising:

providing a ball cap having a crown portion and a bill portion extending from said crown portion, said crown portion being comprised of a flexible structure and said crown portion having a first volume;

providing a cap shaper having a compressible and resilient support apparatus, said support apparatus having a lower surface and an upper surface, said lower surface of said support apparatus being substantially planar, said upper surface of said support apparatus having a curved-hemispherical shape, said support apparatus covered over at least said upper surface of said support apparatus by an absorbent member, said absorbent member comprised of a flexible structure, said support apparatus having a larger volume than said crown portion;

compressing said upper surface of said support apparatus to a size smaller than an inside surface of said crown portion;

introducing said cap shaper within said crown portion so that an upper surface of said absorbent member engages said inside surface of said crown portion;

releasing said cap shaper so that said support apparatus expands to said curved-hemispherical shape and pushes outward on said crown portion of said ball cap to form a curved-hemispherical shaped said crown portion; and absorbing moisture from said crown portion of said ball cap via engagement of said absorbent member with said inside portion of said crown portion.

2. The method of claim 1, wherein said support apparatus is comprised of a memory foam material and wherein said absorbent member is comprised of a cloth material.

3. The method of claim 1, wherein said absorbent member is separately formed than said support apparatus.

* * * * *